US010786056B2

(12) United States Patent
Chung et al.

(10) Patent No.: US 10,786,056 B2
(45) Date of Patent: Sep. 29, 2020

(54) CASE

(71) Applicant: PEGATRON CORPORATION, Taipei (TW)

(72) Inventors: Chih-Cheng Chung, Taipei (TW); Hsiao-Cheng Chen, Taipei (TW); Cheng-Yi Lee, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/248,637

(22) Filed: Jan. 15, 2019

(65) Prior Publication Data

US 2019/0274403 A1 Sep. 12, 2019

(30) Foreign Application Priority Data

Mar. 8, 2018 (TW) ..... 107107949 A

(51) Int. Cl.
*A45C 11/00* (2006.01)
*A45C 1/08* (2006.01)

(52) U.S. Cl.
CPC ..... *A45C 11/00* (2013.01); *A45C 2001/086* (2013.01); *A45C 2011/002* (2013.01); *A45C 2011/003* (2013.01); *A45C 2200/15* (2013.01)

(58) Field of Classification Search
CPC ..... A45C 11/00; A45C 2001/086; A45C 2011/002; A45C 2011/003; A45C 2200/15; G06F 1/16; G06F 1/1626; G06F 1/163; H04M 1/02; H04M 1/04; H04M 1/06;

(Continued)

(56) References Cited

U.S. PATENT DOCUMENTS 9,179,565 B2 * 11/2015 Cho ..... H05K 7/00
10,278,299 B2 * 4/2019 Kim ..... E05D 3/022

(Continued)

FOREIGN PATENT DOCUMENTS

CN 204046661 12/2014
CN 104468891 3/2015

(Continued)

OTHER PUBLICATIONS

"Search Report of Europe Counterpart Application", dated Jun. 11, 2019, pp. 1-7.

(Continued)

*Primary Examiner* — Bryon P Gehman
(74) *Attorney, Agent, or Firm* — J.C. Patents

(57) ABSTRACT

A case includes a back cover, a housing, and a supporting component. The back cover is used to carry an electronic device. The housing is fixed on one side of the back cover opposite to the side carrying the electronic device. The housing includes an assembled portion. The supporting component is assembled on the assembled portion. The supporting component includes a ring-shaped support, a damping round tube, and an assembled cover. The ring-shaped support has a round shaft, the ring-shaped support rotates with respect to the assembled portion by using the assembled cover as a rotating shaft in a first axial direction, the ring-shaped support rotates with respect to the assembled cover by using the round shaft as a rotating shaft in a second axial direction, and the first axial direction is perpendicular to the second axial direction.

6 Claims, 4 Drawing Sheets

(58) Field of Classification Search
CPC ..... H04M 1/18; H05K 5/02; H05K 5/0226; H05K 5/0234; H05K 5/03; H05K 7/00
USPC ..... 206/45.2, 45.23, 320
See application file for complete search history.

(56) References Cited

U.S. PATENT DOCUMENTS

| | | | | |
|---|---|---|---|---|
| 2015/0257288 | A1* | 9/2015 | Livernois | F16M 11/38 248/346.06 |
| 2017/0104854 | A1 | 4/2017 | Park | |
| 2017/0135234 | A1 | 5/2017 | Kim | |
| 2018/0013463 | A1* | 1/2018 | Jeon | H04B 1/3888 |

FOREIGN PATENT DOCUMENTS

| | | | | |
|---|---|---|---|---|
| CN | 205987034 | | 2/2017 | |
| CN | 206533648 | | 9/2017 | |
| CN | 206831120 | | 1/2018 | |
| KR | 101316363 | | 10/2013 | |
| TW | M465595 | | 11/2013 | |
| WO | WO-2012086908 | A1 * | 6/2012 | A45F 5/00 |
| WO | WO-2018012884 | A1 * | 1/2018 | H04M 1/04 |

OTHER PUBLICATIONS

"Office Action of Europe Counterpart Application", dated Apr. 30, 2020, p. 1-p. 6.

* cited by examiner

CASE

CROSS-REFERENCE TO RELATED APPLICATION

This non-provisional application claims priority under 35 U.S.C. § 119(a) to Patent Application No. 107107949 filed in Taiwan, R.O.C. on Mar. 8, 2018, the entire contents of which are hereby incorporated by reference.

BACKGROUND

Technical Field

The application relates to a case, and in particular, to a case including a supporting component.

Related Art

Various portable electronic devices, for example, mobile telephones, smartphones, tablet computers, portable recreational machines, notebook computers, and cameras have such features as being convenient and easy to carry, to operate, and to use, and having a small space occupation rate. Currently, almost everyone owns and carries along one of the electronic devices.

The portable electronic device cannot be independently supported in a horizontal plane, so that a user needs to make the portable electronic device lean against a vertical plane, and it is difficult to adjust the portable electronic device to an appropriate viewing angle. Consequently, there are cases in which the portable electronic device accidentally slips, falls, and collides with others, causing damage to the portable electronic device. To resolve the cases in which the electronic device cannot be supported in the horizontal plane, various cases having a supporting function emerge.

SUMMARY

The application provides a case including a supporting component.

The case in the application includes a back cover, a housing, and the supporting component. The back cover is used to carry an electronic device. The housing is fixed on one side of the back cover opposite to the side carrying the electronic device. The housing includes an assembled portion. The supporting component is assembled on the assembled portion. The supporting component includes a ring-shaped support, a damping round tube, and an assembled cover. The assembled cover is rotatably disposed on the assembled portion, the assembled cover has a cylindrical groove, and the damping round tube is sleeved with the cylindrical groove. The ring-shaped support has a round shaft, the round shaft is sleeved with the damping round tube, the ring-shaped support rotates with respect to the assembled portion by using the assembled cover as a rotating shaft in a first axial direction, the ring-shaped support rotates with respect to the assembled cover by using the round shaft as a rotating shaft in a second axial direction, and the first axial direction is perpendicular to the second axial direction.

In an embodiment of the application, the case further includes a plurality of lock attachments, where the back cover has a plurality of first lock portions, the housing has a plurality of second lock portions, setting positions of the second lock portions correspond to setting positions of the first lock portions, and the lock attachments passes through the corresponding first lock portions and the corresponding second lock portions to fix the housing to the back cover.

In an embodiment of the application, the case further includes a decorative member, where the decorative member is disposed between the housing and the supporting component, the decorative member has an assembling hole at a position corresponding to the assembled portion, the decorative member has a plurality of through holes, setting positions of the through holes correspond to the setting positions of the second lock portions, the decorative member is connected to the assembled portion through the assembling hole, and the lock attachments pass through the corresponding plurality of first lock portions, the second lock portions, and the through holes to fix the decorative member and the housing to the back cover.

In an embodiment of the application, the supporting component further includes a first damping pad, and the first damping pad is attached between the assembled cover and the assembled portion.

In an embodiment of the application, the assembled cover further includes two fixed pins, and the assembled cover is rotatably disposed on the assembled portion by the two fixed pins.

In an embodiment of the application, the assembled portion includes a hollowed-out round groove, a metal pad, and a second damping pad, the metal pad and the second damping pad are disposed on one side of the hollowed-out round groove opposite to the side on which the ring-shaped support is disposed, the second damping pad is disposed between the hollowed-out round groove and the metal pad, the second damping pad is attached to the hollowed-out round groove, the metal pad is attached to the second damping pad, and the two fixed pins sequentially pass through the hollowed-out round groove, the second damping pad, and the metal pad, and abut against one side of the metal pad opposite to the side on which the second damping pad is disposed.

In an embodiment of the application, an accommodation space is formed between the housing and the back cover.

In an embodiment of the application, the ring-shaped support includes a ring, and the round shaft is formed in the ring.

Based on the foregoing description, when a user intends to operate the electronic device in a horizontal plane, the case in the application uses the design of the supporting component, the ring-shaped support is wrenched, and the ring-shaped support rotates by using the assembled cover as the rotating shaft in the first axial direction and using the round shaft as the rotating shaft in the second axial direction, so that the electronic device can change an angle of the ring-shaped support of the supporting component of the case relative to the housing by means of rotating the supporting component, and the electronic device can be supported in the horizontal plane at an appropriate viewing angle.

To make the foregoing characteristics and advantages of the application more comprehensible, detailed description is made below with reference to the accompanying drawings by using embodiments.

DETAILED DESCRIPTION OF THE EMBODIMENTS

Figure 1:
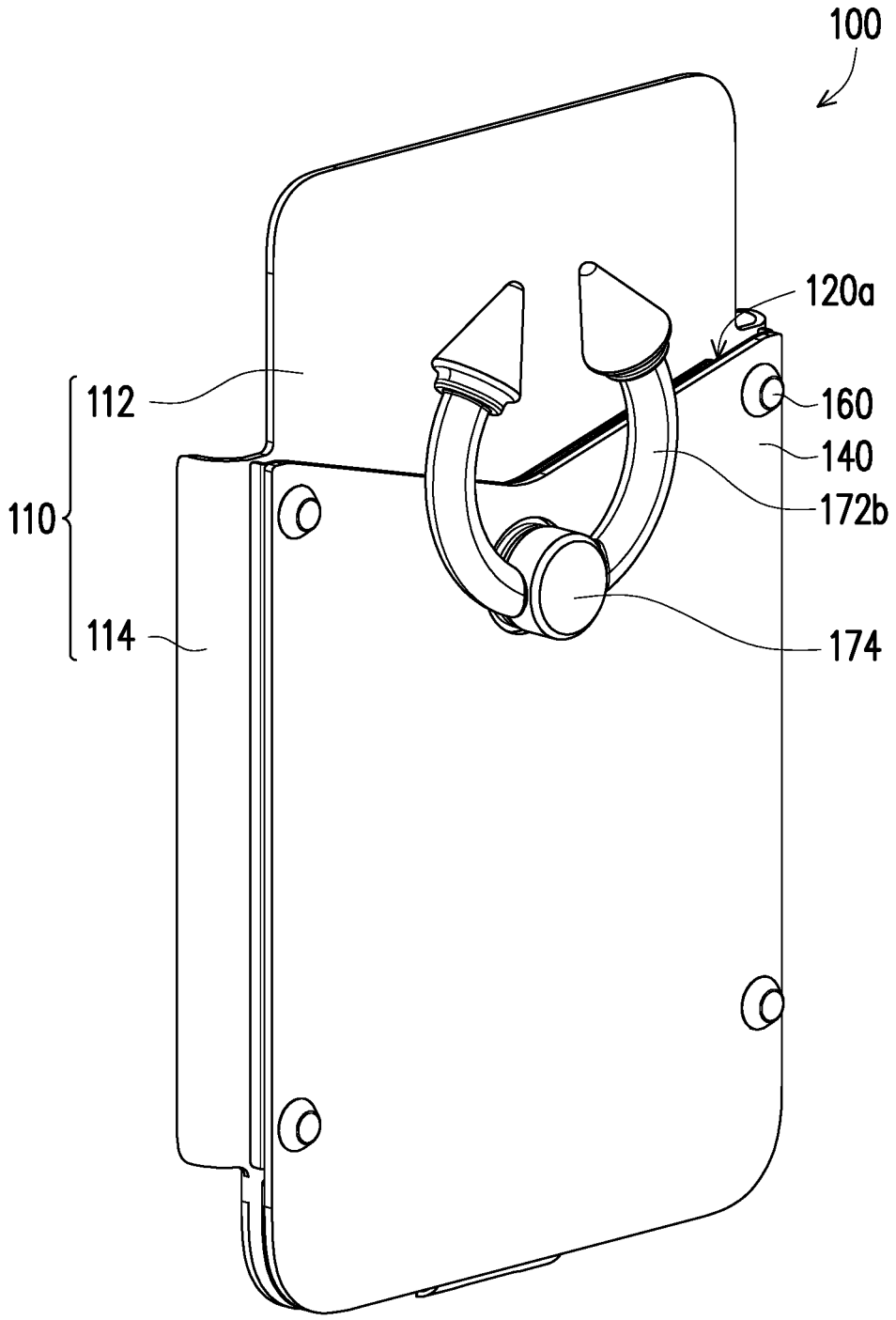
FIG. 1 is a schematic diagram of a case according to the application.
Figure 2:
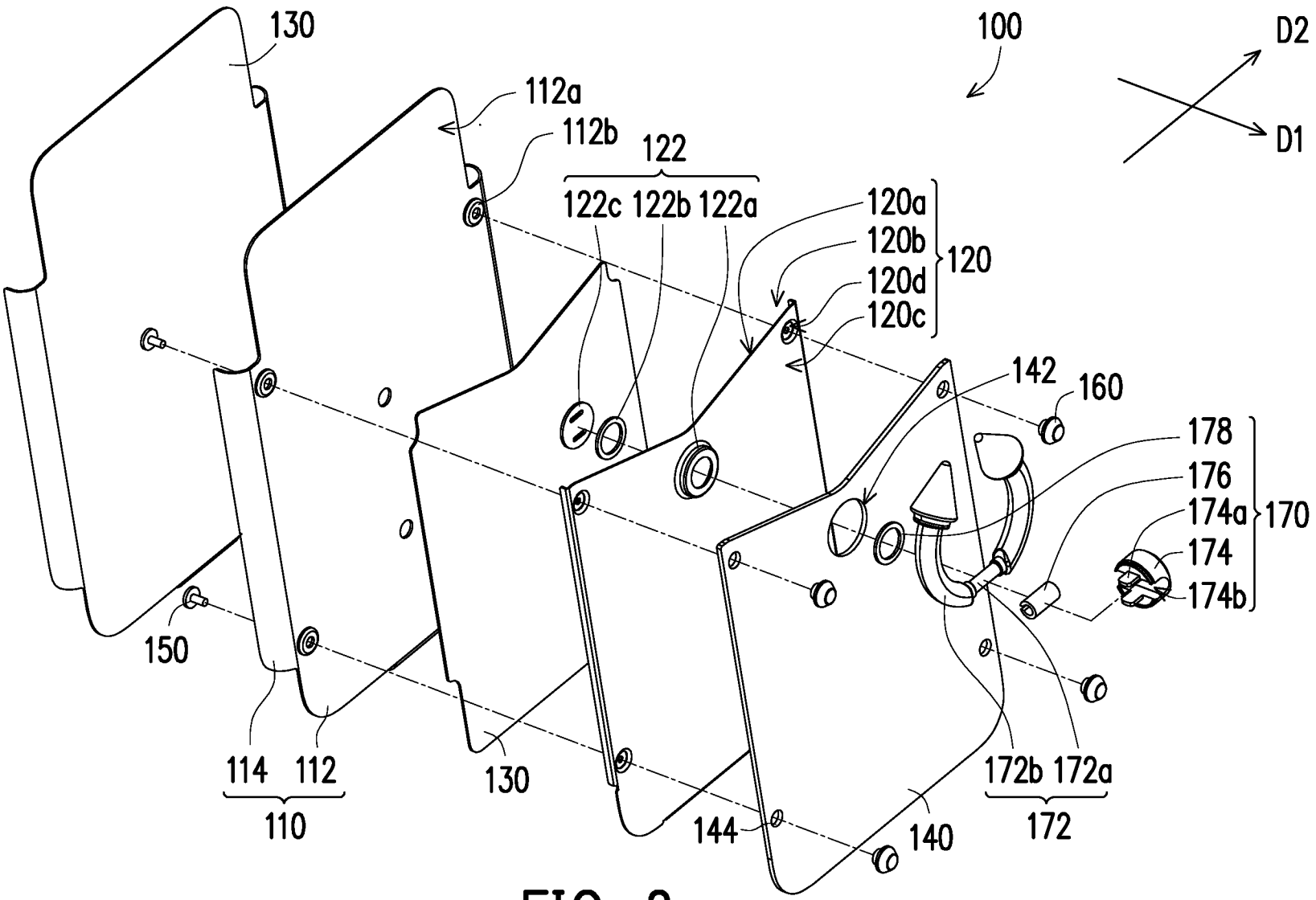
FIG. 2 is a schematic exploded view of the case in FIG. 1.
Figure 3:
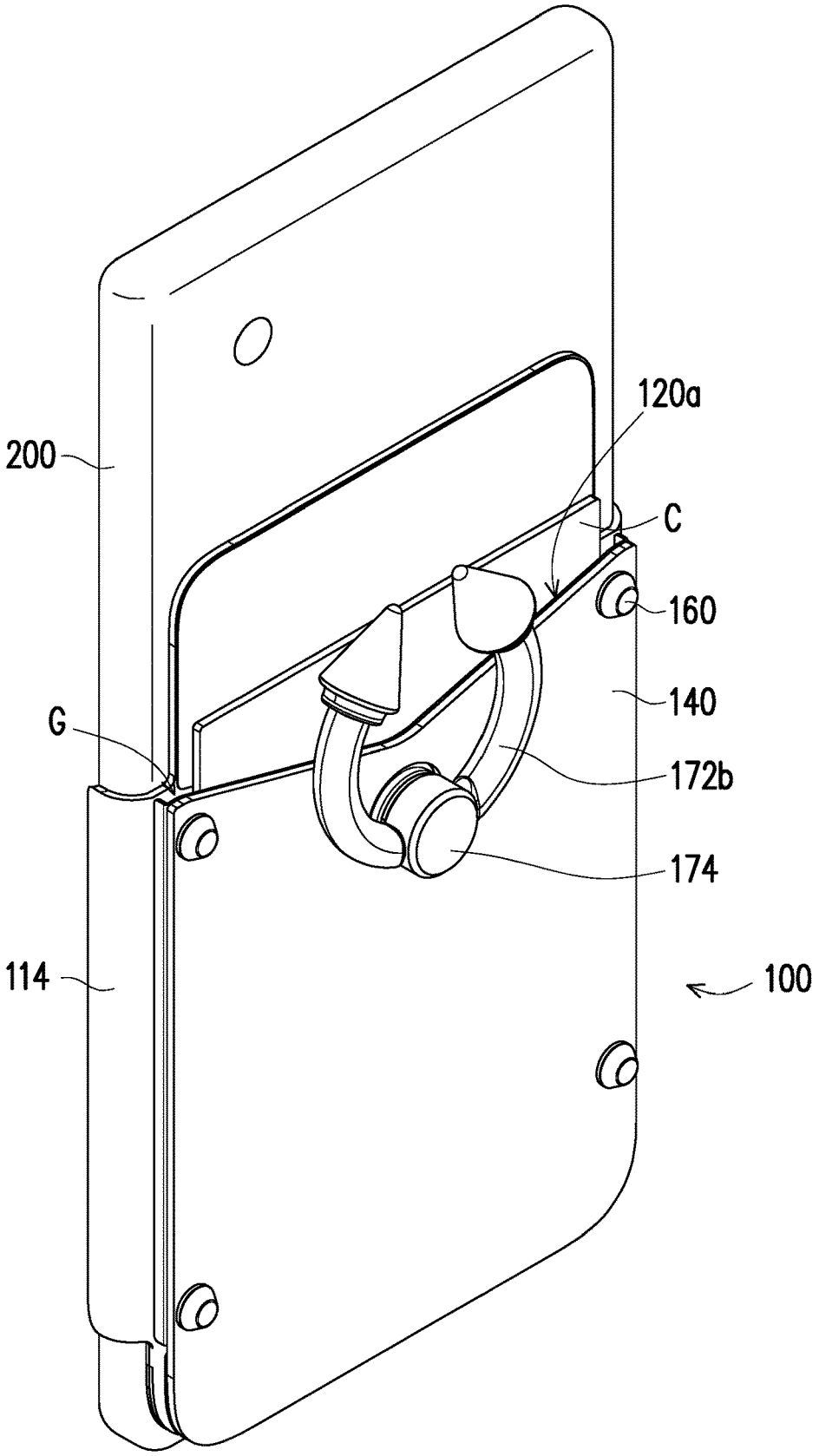
FIG. 3 is a schematic diagram showing that a mobile phone is assembled with the case in FIG. 1.
Figure 4:
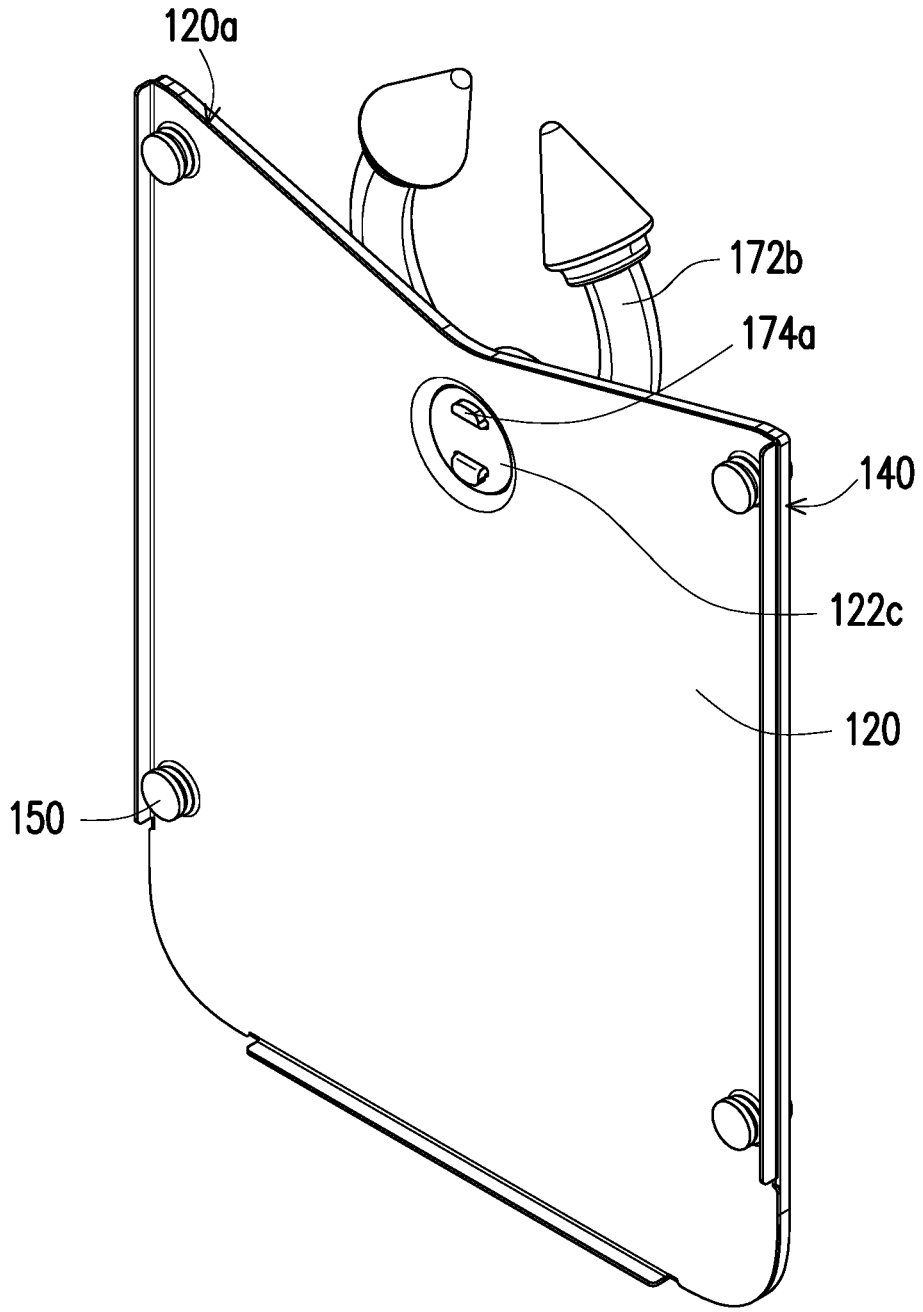
FIG. 4 is a schematic diagram showing that fixed pins abut against a metal pad after punching.

FIG. 1 is a schematic diagram of a case according to the application; FIG. 2 is a schematic exploded view of the case in FIG. 1; FIG. 3 is a schematic diagram showing that a mobile phone is assembled with the case in FIG. 1; and FIG. 4 is a schematic diagram showing that fixed pins abut against a metal pad after punching.

Referring to FIG. 1, FIG. 2, and FIG. 3 together, a case 100 in the application is used to carry an electronic device 200. In this embodiment, for example, the electronic device 200 is a mobile phone. The case 100 includes a back cover 110, a housing 120, and a supporting component 170. The back cover 110 is used to carry the electronic device 200, and the back cover 110 has a cover 112 and a pair of bending portions 114 bending from two opposite sides of the cover 112 to a same direction. The electronic device 200 is assembled with the back cover 110 by using the cover 112 and the bending portions 114. The back cover 110 and the housing 120 in this embodiment may be manufactured by punching different metal sheets. Shapes of the bending portions 114 of the back cover 110 may be designed according to a shape of a side of the electronic device 200, so that the electronic device 200 can be assembled on the back cover 110.

The housing 120 is fixed on one side of the back cover 110 opposite to the side carrying the electronic device 200. As shown in FIG. 2, the housing 120 is disposed on a first surface 112*a* of the back cover 110. An accommodation space G is formed between the housing 120 and the first surface 112*a* of the back cover 110, and the housing 120 has a notch 120*a*, so that it is convenient for a user to draw out an object placed in the accommodation space G. For example, the user may place a card C such as an entrance guard card and an EasyCard, in the accommodation space G. Particularly, the notch 120*a* that the housing 120 has not only has a symmetrically aesthetic feeling in vision, but also can partially expose the card C on the housing 120, so that it is convenient for the user to draw out the card C.

Based on this, the cover 112 of the back cover 110 has a plurality of first lock portions 112*b*, the housing 120 has a plurality of second lock portions 120*d*, and setting positions of the second lock portions 120*d* correspond to setting positions of the first lock portions 112*b*.

To make the case 100 more aesthetic, the case 100 may further include a decorative member 140 disposed on a third surface 120*c* of the housing 120 relative to the second surface 120*b*, and the decorative member 140 may have a shape the same as that of the third surface 120*c* of the housing 120. The housing 120 includes an assembled portion 122, and the decorative member 140 has an assembling hole 142 at a position corresponding to the assembled portion 122. The decorative member 140 is connected to the assembled portion 122 through the assembling hole 142, and the decorative member 140 is disposed between the housing 120 and the supporting component 170, so that the decorative member 140 is fixedly assembled on the housing 120. The decorative member 140 in this embodiment may be a leather part or a plastic part, improving texture of the case 100 in appearance and a sense of touch.

In addition, the decorative member 140 has a plurality of through holes 144, and setting positions of the through holes 144 correspond to the setting positions of the second lock portions 120*d*. The case 100 further includes lock attachments 150, and the lock attachments 150 may further include a pad 160. The lock attachments 150 may pass through the corresponding first lock portions 112*b*, the second lock portions 120*d* and the through holes 144 and then be locked into the pad 160, to fix the decorative member 140 and the housing 120 to the back cover 110. In this embodiment, the pad 160 may be a screw cap manufactured of metal or plastic, and the lock attachments 150 may be screw bolts manufactured of metal or plastic. The lock attachments 150 are covered, making the case 100 more aesthetic in appearance.

In another embodiment, the lock attachments 150 may be directly manufactured into rivets, and the rivets pass through the through holes 144 and the second lock portions 120*d* and are embedded into the first lock portions 112*b*.

The case 100 further includes a supporting component 170 assembled on the assembled portion 122. In details, the supporting component 170 includes a ring-shaped support 172, a damping round tube 176, and an assembled cover 174. The ring-shaped support 172 has a round shaft 172*a*, the round shaft 172*a* is sleeved with the damping round tube 176, and the assembled cover 174 has a cylindrical groove 174*b* and two fixed pins 174*a*. The damping round tube 176 is sleeved with the cylindrical groove 174*b* of the assembled cover 174, so that the ring-shaped support 172 rotates with respect to the assembled cover 174 by using the round shaft 172*a* as a rotating shaft in a second axial direction D2. The assembled cover 174 is rotatably disposed on the assembled portion 122 by the two fixed pins 174*a*, so that the ring-shaped support 172 can rotate with respect to the assembled portion 122 by using the assembled cover 174 as a rotating shaft in a first axial direction D1. The first axial direction D1 is perpendicular to the second axial direction D2.

In this embodiment, because of the damping round tube 176, so that there is sufficient damping between the round shaft 172*a* of the ring-shaped support 172 and the assembled cover 174. In addition, the ring-shaped support 172 can adjust a rotating angle in the first axial direction D1 and a rotating angle in the second axial direction D2, so that the electronic device 200 can be supported in a horizontal plane at a particular angle relative to the ring-shaped support 172.

In addition, to increase damping during rotation of the assembled cover 174 with respect to the assembled portion 122, the assembled portion 122 includes a hollowed-out round groove 122*a*, a second damping pad 122*b*, and a metal pad 122*c*. The metal pad 122*c* and the second damping pad 122*b* are disposed on one side of the hollowed-out round groove 122*a* opposite to the side on which the ring-shaped support 172 is disposed (that is, the metal pad 122*c* and the second damping pad 122*b* are disposed on the side of the second surface 120*b*). The second damping pad 122*b* is disposed between the hollowed-out round groove 122*a* and the metal pad 122*c*, the second damping pad 122*b* is attached to the hollowed-out round groove 122*a*, and the metal pad 122*c* is attached to the second damping pad 122*b*. The supporting component 170 may further include a first damping pad 178, and the first damping pad 178 is disposed and attached between the assembled cover 174 and the hollowed-out round groove 122*a* of the assembled portion 122 (that is, the first damping pad 178 is disposed on the side of the third surface 120*c*). In an assembly sequence, the round shaft 172*a* is sleeved with the damping round tube 176, the damping round tube 176 is sleeved with using the cylindrical groove 174*b* of the assembled cover 174, and the two fixed pins 174*a* of the assembled cover 174 are sequentially passed through the first damping pad 178, the hollowed-out round groove 122*a*, the second damping pad 122*b*, and the metal pad 122*c*, so that the two fixed pins 174*a* are punched and abut against one side of the metal pad 122*c* opposite to the side on which the second damping pad 122*b* is disposed, as shown in FIG. 4.

If the case 100 in this embodiment is to be used, the user first needs to place the electronic device 200 into the space formed by the cover 112 and the bending portion 114.

When the user intends to operate the electronic device 200 in a horizontal plane, the ring-shaped support 172 may be wrenched, so that the ring-shaped support 172 rotates by using the round shaft 172*a* as the rotating shaft in the second axial direction D2 and using the assembled cover 174 as the rotating shaft in the first axial direction D1. Therefore, the electronic device 200 can be supported in the horizontal plane at an appropriate viewing angle by changing an angle of the ring-shaped support 172 of the supporting component 170 of the case 100 relative to the housing 120.

In this embodiment, the ring-shaped support 172 further includes a ring 172*b*, and the round shaft 172*a* is formed in the ring 172*b*. When the user operates the electronic device 200 by holding the electronic device 200, the electronic device 200 may be placed in the palm, and in addition, one of the index finger, the middle finger, or the ring finger passes through the ring 172*b* of the ring-shaped support 172, to further avoid slippery of the electronic device 200 from the hand.

Particularly, the round shaft 172*a* and the ring 172*b* of the ring-shaped support 172 in this embodiment are manufactured integrally, that is, the round shaft 172*a* is not assembled on the ring 172*b*. Therefore, there is no need to worry about cases in which the round shaft 172*a* and the ring 172*b* are not tightly bound or the round shaft 172*a* falls out of the ring 172*b* after the ring-shaped support 172 rotates for many times.

In addition, to avoid falling of the card C from the accommodation space G, the case 100 may further include a cloth sheet 130 adhered to the second surface 120*b* of the housing 120, to increase a contact area with the card C by using the cloth sheet 130 and avoid wearing between the card C and the housing 120. Similarly, a cloth sheet may also be attached to the first surface 112*a* of the back cover 110, to further increase the contact area with the card C by using two cloth sheets 130 and avoid falling of the card C from the accommodation space G, and protect the card C by two sides.

Certainly, the cloth sheet 130 may be attached to one side of the cover 112 opposite to the first surface 112*a*, to avoid wearing between the electronic device 200 and the cover 112.

Although the application is described in the embodiments above, the embodiments are not intended to limit the application. Any person of ordinary skill in the art may certainly make some modifications and improvements without departing from the spirit and the scope of the application, and the protection scope of the application is be subject to the protection scope of the claims attached.

What is claimed is:

1. A case, comprising:

a back cover, used to carry an electronic device;

a housing, fixed on one side of the back cover opposite to the side carrying the electronic device, wherein the housing comprises an assembled portion; and a supporting component, assembled on the assembled portion, wherein the supporting component comprises:

a damping round tube;

an assembled cover, rotatably disposed on the assembled portion, wherein the assembled cover has a cylindrical groove, and the damping round tube is sleeved with the cylindrical groove;

a ring-shaped support, having a round shaft, wherein the round shaft is sleeved with the damping round tube, the ring-shaped support rotates with respect to the assembled portion by using the assembled cover as a rotating shaft in a first axial direction, the ring-shaped support rotates with respect to the assembled cover by using the round shaft as a rotating shaft in a second axial direction, and the first axial direction is perpendicular to the second axial direction; and a decorative member, disposed between the housing and the supporting component, wherein the decorative member has an assembling hole at a position corresponding to the assembled portion, the decorative member is connected to the assembled portion through the assembling hole; and a plurality of lock attachments, wherein the back cover has a plurality of first lock portions, the housing has a plurality of second lock portions, setting positions of the second lock portions correspond to setting positions of the first lock portions, and the lock attachments pass through the corresponding plurality of first lock portions and the second lock portions to fix the housing to the back cover, and the decorative member has a plurality of through holes, setting positions of the through holes correspond to the setting positions of the second lock portions, and the lock attachments pass through the corresponding first lock portions, the corresponding second lock portions, and the through holes to fix the decorative member and the housing to the back cover.

2. The case according to claim 1, wherein the supporting component further comprises a first damping pad and the first damping pad is attached between the assembled cover and the assembled portion.

3. The case according to claim 1, wherein the assembled cover further comprises two fixed pins, and the assembled cover is rotatably disposed on the assembled portion by the two fixed pins.

4. The case according to claim 3, wherein the assembled portion comprises a hollowed-out round groove, a metal pad, and a second damping pad, the metal pad and the second damping pad are disposed on one side of the hollowed-out round groove opposite to the side on which the ring-shaped support is disposed, the second damping pad is disposed between the hollowed-out round groove and the metal pad, the second damping pad is attached to the hollowed-out round groove, the metal pad is attached to the second damping pad, and the two fixed pins sequentially pass through the hollowed-out round groove, the second damping pad, and the metal pad, and abut against one side of the metal pad opposite to the side on which the second damping pad is disposed.

5. The case according to claim 1, wherein an accommodation space is formed between the housing and the back cover.

6. The case according to claim 1, wherein the ring-shaped support comprises a ring, and the round shaft is formed in the ring.

* * * * *